US005134816A

United States Patent [19]

Bradley

[11] Patent Number: 5,134,816

[45] Date of Patent: Aug. 4, 1992

[54] BEAM CLAMP ASSEMBLY FOR CONSERVATORIES

[75] Inventor: Ronald L. Bradley, Bath, United Kingdom

[73] Assignees: Universal Components Ltd.; Design Windows (Systems) Ltd., both of United Kingdom

[21] Appl. No.: 562,707

[22] Filed: Aug. 6, 1990

[51] Int. Cl.[5] ..... E04B 7/02; E04B 7/16

[52] U.S. Cl. ..... 52/82; 52/90; 403/171

[58] Field of Search ..... 52/82, 90, 693, 696, 52/702, 81; 403/171, 172, 176

[56] References Cited

U.S. PATENT DOCUMENTS

| | | | |
|---|---|---|---|
| 2,440,449 | 4/1948 | Raemer | 52/82 |
| 3,908,329 | 9/1975 | Walters | 52/82 |
| 4,357,118 | 11/1982 | Murray | 403/172 |
| 4,384,801 | 5/1983 | Hamel | 403/172 |
| 4,498,800 | 2/1985 | Sielaff | 403/172 |

FOREIGN PATENT DOCUMENTS

| | | | |
|---|---|---|---|
| 405398 | 11/1949 | France | 52/81 |

*Primary Examiner*—David A. Scherbel
*Assistant Examiner*—Robert Canfield
*Attorney, Agent, or Firm*—Laff, Whitesel, Conte & Saret

[57] ABSTRACT

This invention is a beam clamp assembly (100) for use in conservatories where the roof beams (108) radiate from a central part. The beam clamp assembly (100) of the present invention allows use of beams (108) with end surfaces cut at right angles to the longitudinal length of the beam (108).

A beam clamp assembly (100) has a base piece (100), a cap piece (12), abutments for beam ends, and means for clamping the base and cap pieces together with the ends of beams (108) held between them. Beams (108) generally slope downwardly away from the assembly. To allow beam ends cut square to lie flush with the abutments, these are correspondingly angled. They may be provided by facets of a polygonal wall (22) or L-shaped abutment pieces (14) than can be exchanged to allow for different slopes.

14 Claims, 3 Drawing Sheets

BEAM CLAMP ASSEMBLY FOR CONSERVATORIES

The present invention relates to conservatories and to beam clamp assemblies useful in their construction. In the building of conservatories the assembly of beams radiating from a centre is particularly difficult to achieve simply and reliably.

The present invention provides a beam clamp assembly comprising a base piece, a cap piece and means for clamping them together with end portions of beams held between them; wherein the assembly provides a plurality of abutment surface portions for providing (preferably nonvertical) abutments for end faces of clamped beam portion.

The base piece may comprise a floor and wall portions may extend above the floor. The wall portions may be disposed in a part polygonal shape. The walls of the polygon may be arranged around a central hub part. The abutment surface portions may be provided by the walls extending from the floor. Alternatively, the abutment surfaces may be provided by one or more angled abutment pieces locating adjacent the walls. Where angled abutment pieces provide the abutment surface, the walls may extend vertically. An angled abutment piece may be generally L-shaped having internal surfaces mutually at right angles for abutting an end face and an edge of a beam; at least one of the external surfaces being at an angle to the corresponding internal surface. Thus abutment surfaces that would serve to support a beam in one orientation can be enabled to support it in a different orientation of interposition of an abutment piece. The angled abutment pieces may be provided with securing means for their attachment to the base piece. The angled abutment pieces may be grooved, the grooves providing for the location of beams radiating from a finial assembly.

The abutment surfaces may have associated means for the attachment of beams. The cap piece may have a crenellated lower edge, such that in use the beams radiating from the assembly locate through the gaps in the crenellated lower edge.

In order that the invention may be more clearly understood, one embodiment will now be described by way of example only and with reference to the drawings wherein.

Figure 1:
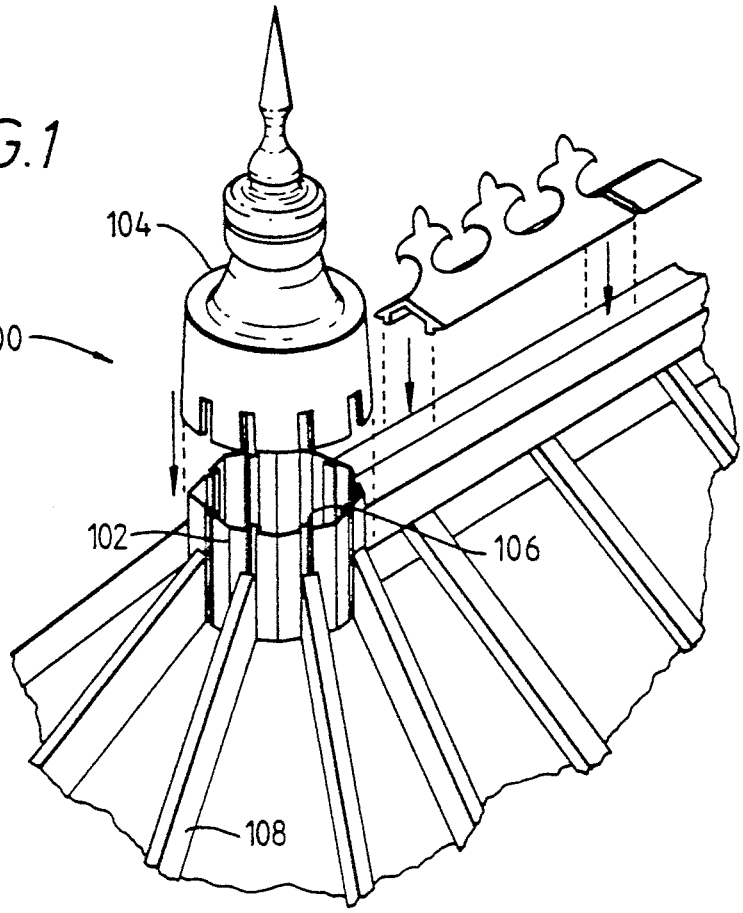
FIG. 1 is a perspective view of a finial assembly as proposed in UK patent application 8726057.
Figure 2:
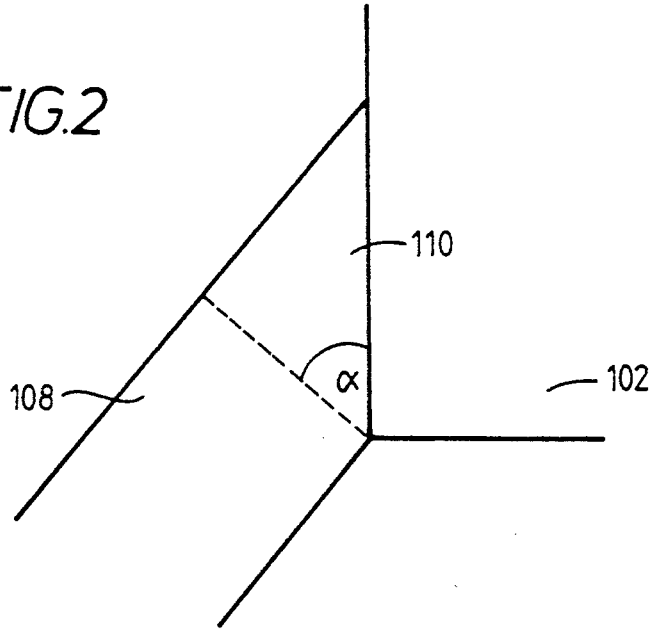
FIG. 2 is a diagrammatic representation of a beam end of a finial assembly of FIG. 1.

The finial assembly 100 shown in FIG. 1 has a finial support 102 and a finial cap 104 for locating over the finial support. The finial support 102 has a plurality of attachment channels 106. Beams 108 radiate from the finial support, being attached thereto via the channels 106. As can be seen from FIGS. 1 and 2 in order that the end 110 of the beams 108 both locate flush against the finial support 102 and slope down from the finial support at the same angle of declination, the end 110 of each beam 108 has to be cut at the same angle a from the normal with respect to the longitudinal length of the beams.

Figure 3:
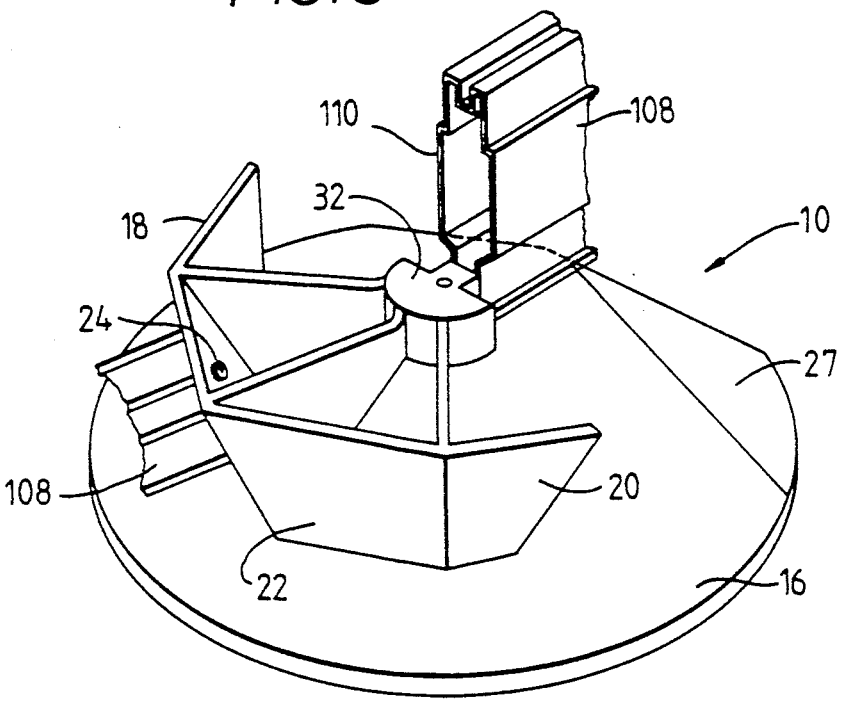
FIG. 3 is a perspective view of a base piece for a finial beam clamp assembly according to an embodiment of the present invention.
Figure 4:
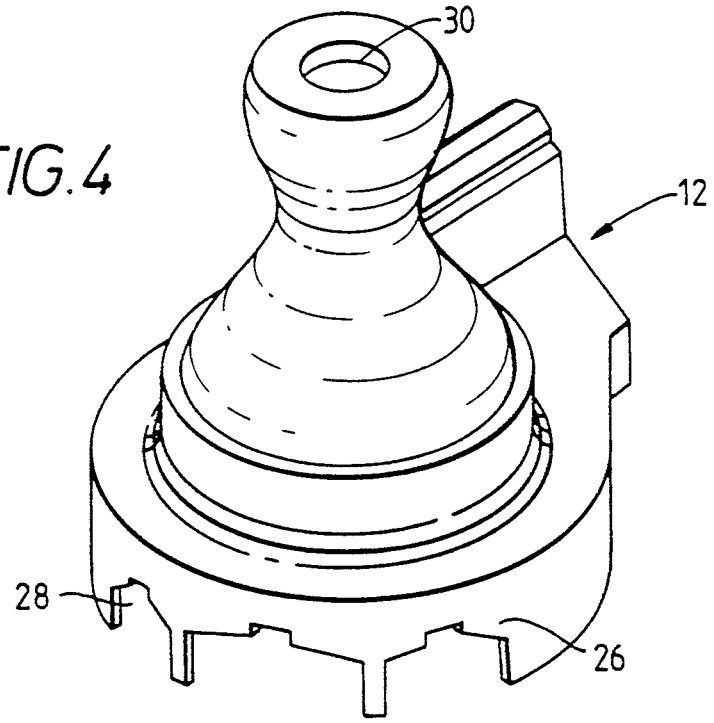
FIG. 4 is a perspective view of a cap piece for the finial beam clamp assembly.
Figure 5:
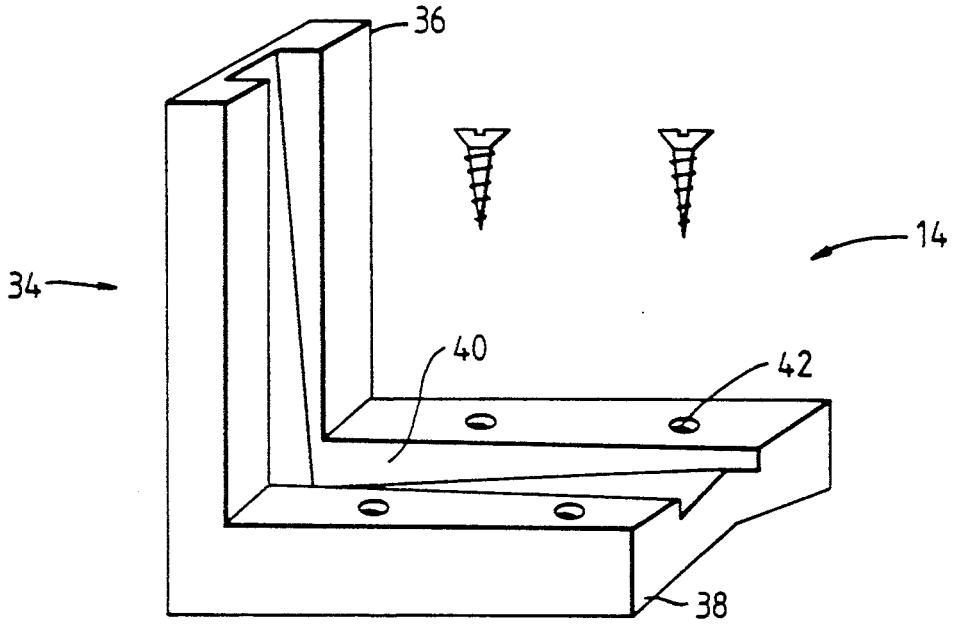
FIG. 5 is a perspective view of an angled abutment piece for the finial beam clamp assembly.

FIGS. 3 to 5 show components of a finial beam clamp assembly, use of which avoids the need to cut the beam ends to special angles. The finial beam clamp assembly comprises a base piece 10, a cap piece 12 and an angled abutment piece 14. The base piece 10 comprises a floor 16 which is substantially circular in plan, and a part polygonal wall construction 18 extending above the floor 16. The walls 20 of the construction 18 extend from the floor 16 at an acute angle to the axis which in use will generally be vertical. This angling of the walls with respect to the floor obviates the necessity of cutting the end 110 of the beams 108 at an angle. Thus the beam ends may now be used without special preparation. Beam ends 110 locate adjacent the planar wall faces 22 to which they may be attached by a nut and screw assembly 24.

In order that the floor piece 16 does not interfere with the downward slope of the beams 108 radiating from the finial assembly 100, the edge 27 of the floor 16 may also slope downwardly.

Conservatories vary in their design, particularly in the number of beams 108 radiating from a finial assembly 100. Thus base pieces 10 may be manufactured having different numbers, sizes and arrays of walls 20 in the part polygonal wall construction. Thus the walls 20 of different base pieces may define different proportions of polygons and/or portions of polygons with different numbers of sides. The angles of the walls of the normal may also differ.

A cap piece 12 shown in FIG. 4 is provided for location over the base piece 10 with beams 108 attached. The cap has a crenellated lower edge 26. When the cap 12 is positioned over the base 10 the beams 108 extend outwardly through the gaps 28 in the crenellated lower edge 26. The base piece 10 and the cap piece 12 may be rigidly secured together by means of a bolt assembly passing through a central hole 30 in the cap and securing into a hub part 32 of the base piece. In this way, the beams 108 radiating and sloping down from the finial assembly, are additionally secured by being clamped between the component base and cap pieces of the finial assembly. Beams extend away from the assembly as a "spider⇄, and the weight of the assembly, which requires no central support, enhances the clamping of the beam.

The angle abutment piece 14 shown in FIG. 5 provides a way of varying the angle at which beams 108 slope down from a finial beam clamp assembly. Of course this could be achieved by the manufacture of a variety of base pieces wherein the angle at which the walls 20 extend from the floor 16 varies. However, the angle abutment piece 14 provides a more suitable way of achieving this effect. The angle abutment piece 14 is of an L-shape, having two arms 36, 38. A groove 40 extends centrally along both arms. Its base provides two abutment surfaces at right angles to each other, and at an angle to the external faces of the arms. Screw holes 42 are provided in either or both arms of the L and to one side of the central groove 40. These screw holes provide for the attachment of the angle abutment piece 14 to the base piece 10 of the finial clamp assembly.

As can be seen from FIG. 5 the L-shaped angle abutment piece 14 has external (40) surfaces at right angles, and also inner (42) surfaces at right angles. However, since the inner normal angle 42 is defined by the sloping surfaces of the two wedge-shaped arms 36 and 38, the plane defined by an inner surface is at an angle with respect to the plane defined by the corresponding outer surface.

Figure 6:
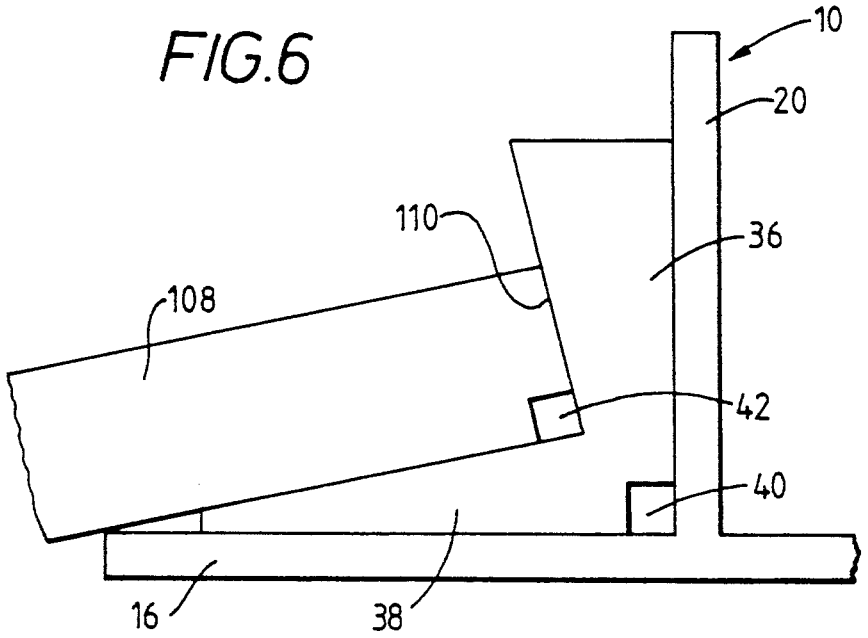
FIG. 6 shows diagrammatically the functioning of an angled abutment piece.

Angle abutment pieces 14 shown in FIG. 5 may be utilised in a beam clamp assembly as shown in FIG. 6.

Where angle abutment pieces 14 are used, the base piece 10 may have walls 20 extending from the floor 16 at an angle normal with respect to the floor 16. The angle abutment piece 14 is positioned in the angle between the floor 16 and wall 20 and at a side of the wall distal to the hub 32. By means of the wedge-shaped arms 36 and 38, the ends 110 of the beams 108 may be located adjacent the inner normal angle 42, the necessary angle of declination for the beams being provided by the slope of the wedge. The beams 108 locate within the channels 40, thereby providing further stabilisation of the assembly.

There may be a variety of said angle abutment pieces 14 for use with a common base piece 10, to provide a range of angles for the beams sloping down and radiating from a finial beam clamp assembly.

I claim:

1. A clamped beam assembly comprising clamp means and a plurality of beans radiating from it in a non-coplanar array each of said beams terminating with an inner end abutment face which is perpendicular to its length, said clamp means comprising:

a. a base piece including a floor defining a base plane and having a plurality of floor portions at angles to the base plane, each of said floor portions supporting an inner end of one of said beams;

b. wall means rising from said floor portions and being arranged in an at least a partly-polygonal array in order to provide a plurality of abutment surfaces for receiving the inner end abutment faces of said beams, said abutment surfaces being perpendicular to their respective floor portions;

c. a cap piece, having a plurality of crenellations along its lower edge; and d. means for clamping the base piece and the cap piece together with said inner end of the beams clamped between them and each of said inner end of the beams being received by one of the crenellations in the cap piece.

2. A beam clamp assembly according to claim 1 wherein the abutment surfaces are angled so that perpendiculars thereto are not coplanar.

3. A beam clamp assembly according to claim 1 or 2 wherein the base piece comprises a floor and one or more walls which extend from the floor.

4. A beam clamp assembly accordingly to claim 3 wherein said walls provide said abutment surfaces.

5. A beam clamp assembly according to claim 4 wherein the floor defines a base plane and the walls are non-perpendicular thereto.

6. A beam clamp assembly according to claim 5 wherein the floor has portions at angles to said base plane which are perpendicular to respective walls so that a beam with an end face at right angles to a major face can abut a wall with its end face and a floor portion with said major face.

7. A beam clamp assembly according to any of claim 3 wherein the walls are arranged around a central hub.

8. A beam clamp assembly according to claim 3 wherein the plurality of abutment surface portions are provided by a plurality of angled abutment pieces locatable on or adjacent the base piece.

9. A beam clamp assembly according to claim 8 wherein the abutment pieces locate against the walls.

10. A beam clamp assembly according to claim 8 wherein the anqled abutment piece is provided with means for securing it to the base piece.

11. A beam, clamp assembly according to claim 8 wherein each angled abutment piece is L-shaped having two arms, with inner surfaces mutually at right angles and at least one of the arms having an outer surface at an angle to its corresponding inner surface.

12. A beam clamp assembly according to claim 11 wherein the inner faces of the arms of each angled abutment piece are grooved and the grooves provide a recess for engaging an end of a clamped beam.

13. A beam clamp assembly according to claim 7 wherein the plurality of abutment surface portions have beam attachment means.

14. A clamped beam assembly comprising clamp means and a plurality of beams radiating from it in a non-coplanar array, each beam terminating with an inner end abutment surface perpendicular to its length; said clamp means comprising a base piece, a crenellated cap piece and means for clamping them together with inner end portions of the beams extending through the crenellations and being clamped between said crenellated cap piece and said base piece by said clamp means; the base piece comprising a floor and wall means rising from an inner region of the floor, said wall means providing an array of planar wall portions arranged so that the inner end abutment surface of each beam abuts a respective planar wall portion.

* * * * *